US008083568B2

(12) United States Patent
Reiss

(10) Patent No.: US 8,083,568 B2
(45) Date of Patent: Dec. 27, 2011

(54) CHILD-INDUCTED, ELECTRICALLY POWERED TOY

(75) Inventor: Steven R. Reiss, Manchester, NH (US)

(73) Assignee: Kid Galaxy, Inc, Manchester, NH (US)

( * ) Notice: Subject to any disclaimer, the term of this patent is extended or adjusted under 35 U.S.C. 154(b) by 304 days.

(21) Appl. No.: 12/383,037

(22) Filed: Mar. 19, 2009

(65) Prior Publication Data

US 2010/0041311 A1 Feb. 18, 2010

Related U.S. Application Data

(60) Provisional application No. 61/188,745, filed on Aug. 12, 2008.

(51) Int. Cl.
*A63H 29/22* (2006.01)
*A63H 29/24* (2006.01)

(52) U.S. Cl. ..... 446/429; 446/400; 446/484

(58) Field of Classification Search ..... 446/69, 446/129, 136, 140, 172, 175, 231, 232, 236, 446/255, 258, 265, 303, 429, 435, 457, 462, 446/484

See application file for complete search history.

(56) References Cited

U.S. PATENT DOCUMENTS

| | | | | |
|---|---|---|---|---|
| 3,886,682 | A * | 6/1975 | Ieda et al. | 446/429 |
| 5,460,560 | A * | 10/1995 | Liu | 446/23 |
| 6,036,574 | A * | 3/2000 | Halford | 446/429 |
| 2002/0106961 | A1 * | 8/2002 | Barthold | 446/36 |

* cited by examiner

*Primary Examiner* — Nini Legesse

(57) ABSTRACT

The present invention is a totally new children's' toy unlike any of its predecessors; and is based on a novel structural relationship and unique pairing of a replenishable power supply cache of direct electric current in the toy construct with an independent supporting assembly having a hand-operable mechanical dynamo and commutator structure. This relationship and pairing is able to provide newly generated electrical energy at will mechanically, by electrical induction; convert the newly generated electrical energy into direct current; and then transfer the newly generated direct current of the supporting assembly on-demand as replenishment energy to the power supply cache of the toy construct for storage. The replenishment direct current stored within the power supply cache is the immediate and sole reservoir of electric energy for powering and operating the functional component(s) of the toy.

10 Claims, 8 Drawing Sheets

CHILD-INDUCTED, ELECTRICALLY POWERED TOY

PRIORITY CLAIM

The present invention was first filed on Aug. 12, 2008 as U.S. Provisional Patent Application Serial No. 61/188,745. The priority of this first filing is expressly claimed herein.

FIELD OF THE INVENTION

The present invention is concerned with a singular child's toy which has a unique power supply cache and internal circuitry for accepting and storing the electric power needed to operate the functional activity of the toy, coupled with an attachable and detachable independent supporting assembly able to generate electric current mechanically by electrical induction on-demand. This unique mode of construction allows a child (and also any adult) to power and launch or activate any electrically powered toy model or design—miniature vehicles, robots, dolls, games, indoor/outdoor toys—repeatedly, via the use of a discrete support base which is able to provide multiple replenishments of direct electric current on-demand.

BACKGROUND OF THE INVENTION

Historically, toys have been and continue to be playthings for children of any age regardless of the child's circumstances, family, culture, or country. Toys often are models of commonplace things; and frequently appear as a miniature replica, or a gadget, or an instrument which provides at least amusement and pleasure (and sometimes education and inspiration as well) for a child.

Initially, all toys were stationary—i.e., the toy had no movable parts either internally or externally. Stationary toys could be relatively simple, such as carvings or sculptures formed of wood, stone, metal and clay which typically appeared as animals, landscapes, or tools/weapons in various sizes; or be quite complex in design such as anatomically correct dolls (male and female), tangible puzzle pieces designed to be fitted together as two-dimensional pictures, and exact scale models of buildings and towns.

With the rise and development of mathematics and engineering in the classical Egyptian, Greek and Roman, Moorish, and Chinese civilizations, more complex and some movable toys were created. These included movable replicas of ox carts, chariots, and sailing ships; games using sticks, dice, dominos, set pieces (such as for chess and checkers), and playing cards; working miniatures of stone throwing and wall piercing siege machines; reproductions of water-wheel turned or animal driven grinding mills ; and the first gravity driven and inertia powered mechanical toys.

Similarly, in the Early and Middle centuries of the $2^{nd}$ Millennium (in the Common Era), liquid-filled glass balls having small movable castings and particles suspended within the liquid appeared; and different kinds of spring loaded and lever powered toys were built—usually for the pleasure and amusement of the children in the noble classes.

Later however, and certainly by the latter half of the $19^{th}$ century in the common era, mechanical wind-up toys having one or more movable parts were commercially manufactured and sold as commonly obtainable articles both in the U.S. and abroad. Merely illustrating the range and variety of such mechanical wind-up toys are the following: U.S. Pat. Nos. 153,023; 189,010; 293,837; 327,303; 356,542; 644,805; 645,364; 819,580; 822,876; and 1,065,783.

Subsequently, and certainly by the mid to late $20^{th}$ century, a variety of toys having internal moving parts powered by an electric source became popular. These electric powered toys are represented and exemplified by: U.S. Pat. Nos. 4,096,660; 4,457,101; 4,816,795; 5,129,852; 5,524,880; 5,364,298; 5,395,275; and 5,762,532. More recent developments and improvements for charging electrically powered toys are represented and described by U.S. Pat. Nos. 5,767,655; 6,575,809; 6,676,480; 6,762,586; 6,776,686; 6,913,507; 6,945,840; 6,957,996; 6,995,542; 7,030,592; 7,259,541; and 7,288,917.

More recently, with the advent of computers and miniaturized electric circuits in the late 1980's, a huge range and variety of electronic games and virtual reality play-stations become the most favored toys for a generation of children. Advertisements of these electronic games and play-stations are an everyday event and appear in almost every newspaper printed in the U.S.

In recent years, however, there has been a popular social movement urging a return to stationary and mechanically moving toys for children. This movement is due in no small part to the psychological phenomenon that a stationary toy or a mechanically movable toy markedly stimulates and develops the creative mind and imagination of a child far more than do electronic games or other visually-based toys. For substantially similar reasons, most children also seem to prefer playing with toys which can be physically grasped by the child or which have functions which are seen by the child as visible movable parts within the toy.

SUMMARY OF THE INVENTION

In its broadest aspect, the present invention is a functional toy comprising:

an electrically powered toy construct able to demonstrate a discernible functional activity, said toy construct being comprised of (a) a fabricated body of predetermined dimensions and prechosen spatial configuration, (b) at least one functional component in said fabricated body whose activity is powered by direct current, (c) a power supply cache of direct current which can repeatedly receive and store direct current, be exhausted, and then be replenished with direct current on-demand, (d) electrical communication means between said functional component and said power supply cache, and (e) current receptor means for receiving direct current from an independent source on-demand and conveying received direct current to said power supply cache; and an independent supporting assembly able to be repeatedly attached to and detached from said toy construct, said supporting assembly being comprised of (i) a module shell of preset dimensions and fixed overall shape adapted for at will electrical connection to and disconnection from said toy construct, (ii) a hand-operable mechanical dynamo able to generate electrical energy by mechanical induction on-demand, (iii) a commutator structure in communication with said mechanical dynamo and adapted for converting said generated electrical energy into direct current, and (iv) electricity transfer means in communication with said mechanical dynamo and said commutator structure, and adapted for transferring direct current to said current receptor means of said toy construct on-demand.

This mechanically inducted and electrically powered toy can offer a diverse range of alternative electrically-powered capabilities, and can perform a wide variety of different functions. These alternatives include at least one discernible functional activity selected from the group consisting of motility, light emission, and sound emission.

In many instances and embodiments of the present invention, two or more of these different functions and capabilities (i.e., motility, light emission, and sound emission) will be combined and coexist together within a single toy —e.g., a toy duck will walk on its legs and make squawking sounds at the same time. In addition, each individual function and activity may itself appear in multiple formats and be present in a range of alternative forms and guises within a single toy—e.g., a toy airplane may be flown forward in the air by a propeller and an electrically-driven motor; and also, via other electric motors in the toy, be able to make turns while flying in the air via movable flap panels mounted on its wings and/or a movable rudder mounted on its fuselage.

BRIEF DESCRIPTION OF THE FIGURES

The present invention may be better understood and more readily appreciated when taken in conjunction with the accompanying Drawing, in which.

DETAILED DESCRIPTION OF THE PRESENT INVENTION

Figure 1:
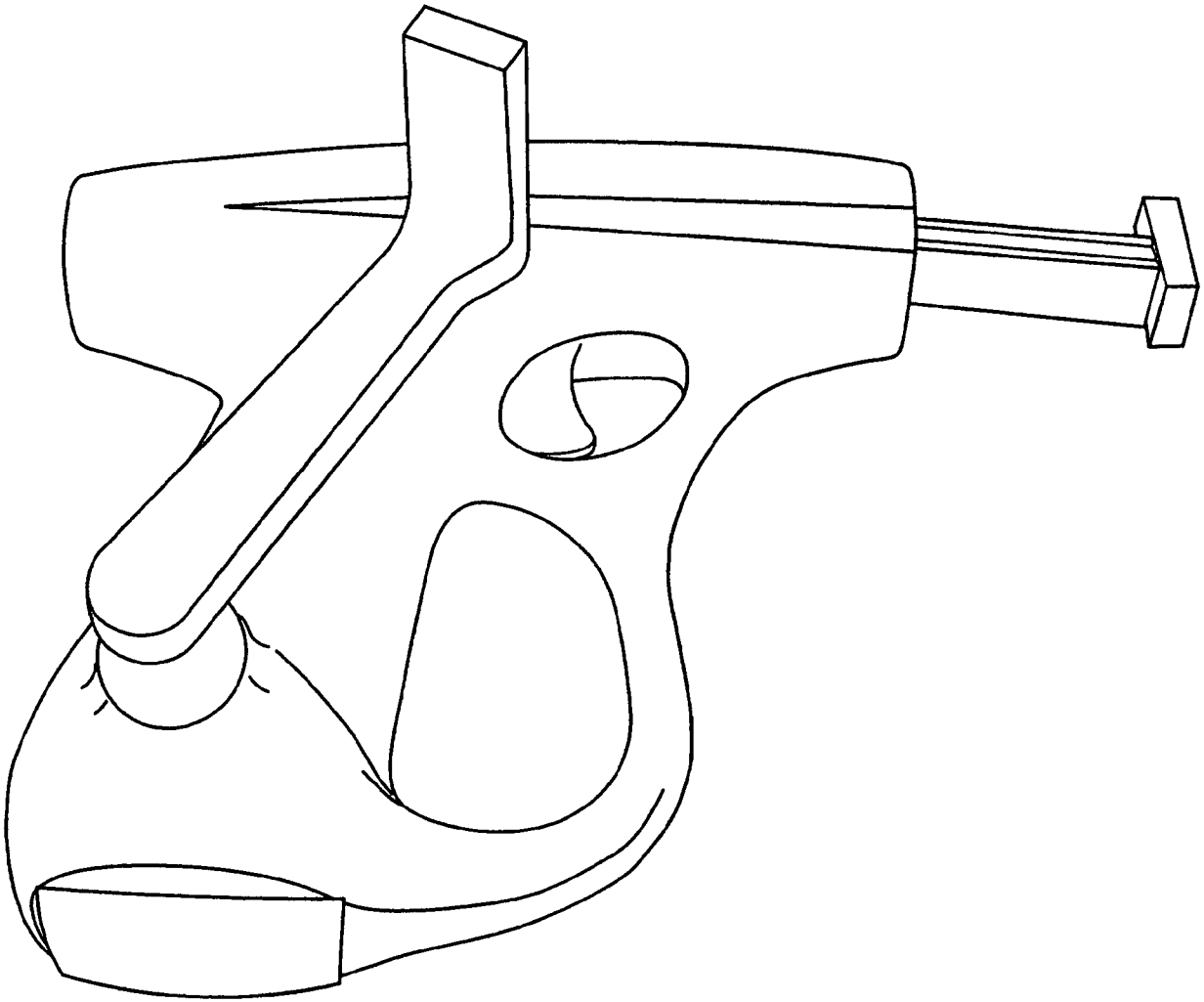
FIG. 1 illustrates a preferred embodiment of the present invention which comprises a toy construct formed as a model automobile and an independent supporting assembly formed as a discrete launcher/charger base.

It is important to understand properly what the present invention truly is, and also to be able to distinguish the present invention from what it is not.

The invention is a child's toy, a self contained entity intended for the amusement, entertainment, and perhaps imagination of a child (and even some adults). If desired, the toy can be enjoyed and played with as is, a stationary and inanimate object. However, the same toy can be employed as a rechargeable electrically-powered functional toy having demonstrable activity, but having no need or use for a permanently joined external power/electric charge source.

I. The Subject Matter Comprising The Present Invention As A Whole

The instant invention is a totally new children's' toy unlike any of its predecessors; and is based on a unique structural relationship and pairing of a replenishable power supply cache of direct electric current in the toy construct with an independent supporting assembly having a mechanical dynamo and commutator structure. This relationship and pairing is able to provide newly generated alternating electric energy at will mechanically, by electrical induction; convert the newly generated alternating electrical energy into direct current; and then transfer the newly generated direct electric current of the supporting assembly on-demand as replenishment energy to the power supply cache of the toy construct for internal storage. The direct electric current internally stored and held within the power supply cache is the sole reservoir of electric energy for immediately powering and operating the functional component(s) of the toy.

Unexpected Benefits And Advantages Of The Invention

Accordingly, this toy structure and organization allows a child or an adult to hand-generate direct electric current; to energize (charge and re-charge repeatedly) the self-stored power supply cache of the toy construct on-demand; and to activate and operate an electric-powered toy without any need for either a consumer-replaceable battery or a permanent electrical connection to a remotely located source of direct electric current.

It will be noted and appreciated that conventionally engineered toys require and use either small replaceable/rechargeable storage battery cells to power the toy; or sometimes utilize a combination of a capacitor circuit and set of standard batteries to transfer electric power to the toy. In these latter instances, the user usually presses a power button to release energy from the battery cells in order to charge up the motor of the toy. The conventional toy is then launched or energy activated for a short, battery-powered, operational period.

A most unexpected and unique feature of the present invention is that no consumer-replaceable battery is used or required as a source for energizing or providing electrical power to the toy. Thus, no consumer-replaceable battery purchases, recycling, or disposal are required or desired.

An additional advantage is that there is no diminishing loss of operating power for the toy over its use time as commonly occurs with conventional battery-powered toys when the electric energy is quickly drained out of the storage batteries by the continuous operation of the toy. To the contrary, all the necessary electrical energy to power the full function and complete action of the toy for normal operation is generated anew, repeatedly, and in full by the mechanism of electrical induction. Thus, inducted electric energy generated via the hand cranking or otherwise rotation of the dynamo mechanism and commutator structure within the independent supporting assembly on each use occasion is the means and the manner by which a serviceable and replenishable direct electrical charge is generated and subsequently transferred on-demand to the toy's on-board power supply cache.

II. The Two Essential Parts Of The Invention

For illustrative purposes only, a preferred embodiment of the present invention is shown by FIG. 1. As seen therein, this exemplary embodiment comprises a toy construct formed as a model automobile and a supporting assembly formed as a separate and independent launcher/charger base.

In substance therefore, the present invention is a mechanically inducted, electrically powered functional toy comprised of two essential parts:

a toy construct able to demonstrate a discernible activity; and an independent supporting assembly able to generate direct electric current on-demand by mechanical induction.

It will be recognized and appreciated that each of these two essential parts comprises its own particular elements and specific features; and each of these requisite elements and features must appear and be manifested in at least a minimalist form in each and every embodiment of the invention. For these reasons, each essential part will be described individually in detail below; and the full range and diversity of its intended formats and tangible manifestations will be adduced to demonstrate the variety and scope of the possible embodiments.

A. The Toy Construct:

Each embodiment of the toy construct must include and demonstrate all of the following particulars:

(1) A Fabricated Toy Body of Predetermined Dimensions and Prechosen Spatial Configuration.

The toy body is a prepared article of manufacture which can be fabricated to meet and satisfy any preselected engineering specifications and to exhibit any prechosen image, appearance, display, or design as is deemed desirable. As a tangible entity, the fabricated toy body may conform to any desired set of dimensions; occupy any wanted spatial volume; and present any intended configuration. It is noted also that the overall form of the fabricated toy body may be geometrical or non-geometrical; symmetrical or non-symmetrical; regular or irregular; continuous, or contiguous, or interrupted; fragmented or unitary; and present one topological surface or multiple topological surfaces.

In its preferred embodiments, the fabricated toy body is a portable entity; and in the most preferred forms is small enough that it can be carried by a child less than ten years of age. Similarly, although there are no limits or restrictions as such concerning either the weight or mass of the toy body, the most favored examples will weight less than about 3 lbs; range from about 6 inches to 2 feet in length; and have an overall girth of less than about 18 inches.

In addition, in many of its preferred formats, a part or portion of the fabricated body will include and provide a positional support fitting—i.e., a carefully prepared discrete external plane, platform, or projection which is integral with and forms a discrete part of the toy construct. The positional support fitting is fashioned to be dimensioned, oriented, contoured, and aligned for at will temporary physical juncture to and subsequent removal from the module shell of the supporting assembly (described in detail hereinafter); and the positional support fitting will also typically provide at least some of the wiring and circuitry for repeated electrical connection to and subsequent disconnection from the supporting assembly on-demand.

Materials for Fabricating the Toy Body

The materials which can be used to make or to fashion the toy body encompass and include all the naturally occurring compositions and all the chemically or synthetically created substances available to man. The true diversity and wide range of suitable materials therefore are merely represented by: the known varieties of wood, paper, paper pulp, chipboard, and compressed paper/chipboard products; the conventionally available metals, metal alloys and mixtures, and composite metallic products; commonly used glasses, clays, porcelains, and ceramics; any and all plastics in their various formulations and combinations including polyethylene, polypropylene, acrylics, and the like; and fibers, cloths and textiles in woven and non-woven patterns. In short, any substance known to man may be employed alone or in combination with other matter as the material from which to fabricate the toy body.

Moreover, the fabricated toy body can optionally be augmented by any or all of the following: The body can be colored, painted, or exteriorized in any manner, style, or degree; or be sheathed, clothed, or covered by one or more layers of other material; or have sculpted attributes and surface contours; or show a human-like appearance via the presence of hair, eyes, a face, and/or other anatomically correct human body proportions and features.

The fabrication of the toy body as a whole will include any and all conventionally known modes of manufacture and assembly; and frequently will utilize several differently manufactured pieces which are then collectively joined together to yield the complete fabricated body. Some of the more commonly used manufacturing techniques will include moldings, castings, extrusion processes, stamping, and sheet metal bending. Similarly, among the many different bonding and attachment methods conventionally used to the pieces of a toy body together as a unitary whole are glues, adhesives, and epoxies of diverse formulation; sonic soldering, thermal soldering, radiation bonding, and welding; sewing, riveting, and different kinds of mechanical couplings and attachments (such as nails, screws, and nuts & bolts).

Typical Toy Body Appearance

In many desirable instances and preferred embodiments, the fabricated toy body will appear as a portable miniature, a hand-held model, or a small-sized representation of realistic objects and things, or of imaginary characters and beings; or of animals and humans now living or long since dead. The range and diversity of these images and representations thus encompass such entities as have not yet been brought into existence, or which exist in fact today, or have previously existed; and include those items which have been conceived but have not yet been created in reality, or are in utilitarian service today, or were once available in the past.

Moreover, the appearance of the fabricated toy body will often be a reflection of not only facts and reality, but also of imagination and fiction. Often the most creative thoughts and artistic impressions are shown and expressed by the image and appearance of a toy; and all of these are eminently suitable as representations for the fabricated toy body.

The suitable toy formats and representations thus encompass: erections and buildings such as pyramids, ancient temples, modern factories, skyscrapers, bus stations, airports, railroad stations, and ship terminals; moving vehicles of every kind such as carts, motor cars, trucks, trains, ships and boats, propeller planes, jets, future spacecraft and flying saucers; robots and robotics of any kind; all known animals species (prehistoric and not); all human forms typically dressed in their various occupations, vocations, professions and jobs and ranging in evolutionary development from the earliest Neanderthal and Cro-Magnon man up what might be the next (as yet unrealized) stage of human advancement; and all the purely imaginary characters (human and non-human) portrayed in everyday comic strips, comic books, televisions shows, films, books, and the like.

(2) At Least One Functional Component in the Fabricated Toy Body Whose Activity is Powered by Direct Current.

The fabricated toy body will offer and provide not less than one functional component whose action is powered by direct electrical current. A diverse range of electrically-powered action capabilities are available, and an immense variety of different activities can be performed. The functional choices broadly include at least one discernible activity selected from the group consisting of motility, light emission, and sound emission. Among these different functional choices, however, the activity of motility is prime and of the first importance; and consequently is by far the most frequently appearing and desirable attribute.

Motility as the Primary Functional Activity

Motility, by definition, is the attribute or characteristic of being capable of physical movement in some manner or degree. Thus, when the functional activity of the toy is motility, there will be at least one part or component of the fabricated toy body which demonstrably is movable—if and when direct electric current is given to power that component.

The precise nature, or degree, or extent of discernable movement, as well as the particular style of moving action, which is offered by the motile component of the toy, are not relevant, nor meaningful, nor of any true importance. To the contrary, any kind, type, or degree of movement or physical action which is exhibited and recognized as a discernible act of movement or mode of displacement is sufficient.

Accordingly, the discernible motion can be any of the following: a particular physical action such as rotation, waving, swinging, or vibration; a specified manner of movement such as walking, rolling over, jumping, or dancing; a change of toy body posture or toy body orientation such as a gesture, shift, signal or sign; and an act of transit such as a migration, passage, relocation, or displacement.

It is intended and expected that the moving action of a toy will typically be created and provided by one or more conventional electric motors powered by direct electric current. Each electric motor will drive and move at least one movable part of the toy so long as sufficient direct current is provided; and the particular engineering requirements for electric powered motion and the necessary freedom of action of the movable parts of the toy are deemed to be commonly available knowledge and information.

In addition, some alternate means of discernible movement for the toy will often include electro magnetic attraction/repulsion and vibration-caused movement (thru use of a motor-driven mechanism).

It will be noted and appreciated also that the primary functional activity of motility is the most frequently occurring, generally appearing, and commonly shared property in all preferred embodiments of the toy construct; and the characteristic activities of discernible movement and observable physical action provided by the motile component(s) of the toy construct are most wanted and enjoyed by children of every age. Accordingly, if only one functional activity is to be provided and demonstrated by the toy construct, then that chosen discernible activity will almost always be motility.

Light Emission as a Functional Activity

Light, by definition, is electromagnetic radiation capable of inducing visual sensation; and for human direct visualization of light rays occurs with wavelengths ranging between about 400 and 800 nanometers.

Illumination, by definition, is the quantity of light or luminous flux falling on a unit area of a surface. Illumination is inversely proportional to the square of the distance of the surface from the source of the light; and is proportional to the cosine of the angle made by the normal to the surface with the direction of the light rays.

Thus, when the functional component of the toy is light emission, there will be at least one section of the fabricated toy body which is demonstrably able to produce light which is then visible to the naked human eye—if and when direct electric current is given to power that light emitting component.

The precise nature of the illumination, or the degree or extent of illumination, and/or the particular means for providing illumination which are offered by the light emitting component of the toy are unimportant and non-substantive. To the contrary, any conventionally known kind of light emitting equipment and any commercially available source of illumination which is suitable for inclusion as a part of the toy and which will provide a form of light emission which can be seen and recognized by the human eye is adequate and sufficient for use with the present invention. Accordingly, the most common types of illumination will include incandescent bulbs, light emitting diodes, liquid crystal displays and fiber optically transmitted illumination again using light supplied by incandescent bulbs, and LEDs. Furthermore, some kinds of toys will also be able to change their external color owing to the application of a direct current—i.e., the toy's external coloring can be changed thru an internal application of electric current to a pigment or plastic in the body of the toy that is current-sensitive.

It will be understood also that the functional activity of light emission is to be considered as being secondary in importance and value for the toy construct in comparison to the functional activity of motility described previously herein. Thus, while being very desirable for itself, the functional activity of light emission itself is deemed to be subordinate and entirely optional.

Sound Emission as a Functional Activity

Sound, by definition, is periodic vibrations and waves transported within gases, liquids, and solid elastic media. In humans, the sensation of sound is felt when the eardrum is acted upon by air vibrations within a limited frequency range of about 20 Hz to 20 kHz. Consequently, sound of a frequency below 20 Hz is typically called "infrasound", while sound above 20 kHz is often termed "ultrasound".

Thus, when the activity of the functional component of the toy is sound emission, there will be at least one section of the fabricated toy body which is demonstrably able to produce air vibrations within a limited frequency range of about 20 Hz to 20 kHz—if and when direct electric current is given to power that sound emitting component.

In addition, for purposes of the present invention, neither the precise manner by which sound is produced; nor the frequency or frequencies of the produced sounds; nor the degree or extent of the produced sound; nor the particular apparatus for creating sound are critical, or important, or substantive. To the contrary, any conventionally known kind of sound or series of sounds, and every sort of commonly available sound emitting equipment are deemed to be adequate and sufficient for use with the present invention. Thus, typical sound emitting devices would include standard speakers, piezio electric mini speakers, and digital sound emitters.

It will be understood also that the functional activity of sound emission is also to be considered as being secondary in importance and value for the toy construct in comparison to the primary functional activity of motility described previously herein. Thus, while being very desirable for itself, the functional activity of light emission itself is deemed to be subordinate and entirely optional; and the presence or absence of a sound emitting function for the toy construct is solely a matter of personal choice and individual selection.

Combinations of Multiple Functional Capabilities

It will be readily recognized and appreciated that, in many preferred embodiments of the present invention, two or more of these different functions and capabilities (i.e., motility, light emission, and sound emission) can and will appear together, be performed in tandem, and act in concert for a single toy. As a simple example, a toy freighter will rotate its ship's propeller, display blinking colored lights throughout different parts of the vessel, and blast its ship's horn periodically. Thus, even by this one example, three different functional activities are readily recognized and demonstrated.

In addition, each individual functional component and activity may itself appear in multiple formats and be present in a range of alternative formats and styles within a single toy. For example, a toy train will be moved forward and backward via the power from one electric motor in the locomotive; and provide a milk car which can load and unload individual cans of milk using a second electric motor; and include a caboose where a third electric motor powers a miniature flagman who waves a red flag each time the train begins to move forward. Thus even in this simple illustration, the same type of functional component and activity—motility—is employed and displayed multiple times in three completely different settings by a single toy.

(3) A Power Supply Cache of Direct Electrical Current which can Repeatedly Receive and Store Direct Current, be Exhausted, and then be Replenished with Direct Current On-Demand.

Each toy construct will provide and include a self-storing, but limited, power supply cache of direct electric current as an internally stored inventory and immediately available reservoir of electrical energy. This internally accumulated power supply is a cache which can be repeatedly depleted and exhausted—i.e., completely drained of its stored electric charge; and then repeatedly replenished on-demand with newly generated direct current—i.e., recharged with additional direct electric current of a particular voltage—from an outside independent source capable of mechanically generating inducted electric current at the will and choice of the child (or adult).

The purpose of the power supply cache is to provide an immediately available reservoir of direct electric current to the functional component(s) of the toy construct; and to power the particular functional activity (or activities) of the toy—be it motility, light emission, or sound emission alone or in any multiple combination. Thus, as illustrative of movement action embodiments, the direct electric current stored by the power supply cache is typically supplied to one or more electric motors which act to operate and drive the movable parts of the toy. Similarly, as illustrative of light or sound emission examples, the direct electric current stored within the power supply cache is supplied as needed to the light and/or sound equipment, which are then present as necessary components of that toy.

In each and every embodiment of the present invention, the power supply cache will exhibit certain attributes and features. These include:

- The power supply cache is a self-storing and discrete reservoir of direct electric current for the toy;
- The power supply cache is the only immediately available reservoir of direct electric current that exists within the toy construct to power the functional activity component (s);
- The power supply cache is limited in the amount of direct electrical current that it can hold and store;
- The full stored quantity of direct electrical current able to be held by the power supply cache will be utilized, depleted, and exhausted by operating the functional activity of the toy;
- The depleted and exhausted power supply cache can be recharged on-demand and in full repeatedly with replenishment direct electric current, which is received from an outside independent source of electrical energy; and
- The recharged power supply cache can be utilized in full, depleted, and exhausted again at any time by once more operating the functional activity of the toy.

In the preferred embodiments of the invention, it is intended and expected that the power supply cache of stored direct electric current for the toy will appear in either of two different structural formats. These are: a rechargeable energy cell unit; and a rechargeable capacitor circuit. Each format is described individually below.

The Rechargeable Cell Unit

The rechargeable cell structure will provide the larger energy storage capacity that is typically needed to power both a vehicle's electric motor and a remote control unit for vehicular directional control. The cell unit structure is thus the preferred format when a larger quantity of direct electric current is required to power the functional activity of the toy; and also when the toy is intended to be operated over an extended period of time.

Preferably, the rechargeable unit is a small Li Po cell battery which can receive and store sufficiently large quantities of direct current needed for higher current toy operations and applications. In the virgin state, the onboard Li Po cell battery will receive and absorb direct electric energy from an independent source able to generate mechanically inducted, electrical energy. Once charged in full, the Li Po cell battery will supply stored energy to the motors, lights and sound speakers of the toy until the current is completely depleted. The onboard Li Po cell battery then can be recharged on-demand by placing the cell battery in electrical communication again with the same independent source able to generate mechanically inducted, electrical energy. The transfer of direct electric current and power storage process then begins anew.

The Rechargeable Capacitor Circuit

A capacitor, by definition, is an electrical apparatus having two conducting plates (typically called "electrodes" or "conductors") separated by a layer of insulating material (frequently termed the "dielectric"). This apparatus thus will have an appreciable capacitance (the ratio of its total charge to its potential as determined by $C=Q/V$); and each electrode will carry a measurable charge of electricity.

For construction purposes, the dielectric or insulating material of a capacitor is commonly chosen from among a variety of materials including: a vacuum, paper, mica, glass, plastic foil, fused ceramic, cellulose, porcelain, Mylar, Teflon, or air. Conversely, the conducting plates may be fashioned from any conductor or semi-conductor substance. However, the fully formed capacitor is typically the result of multiple sheets of metal foil and insulating material co-wound in staged layers to form an integrated compact article.

It will be recognized and appreciated also that, in theory, the dielectric can be any non-conductive substance. However, for many practical applications, specific insulating materials are chosen and utilized that best suit the capacitor's intended or expected functions. For this purpose then, the choice of dielectric dictates what kind of capacitor it is to be; and decides and controls for what particular applications that capacitor is best suited. Thus, depending on the size and type of dielectric, some capacitors are best for high frequency uses, while other dielectric materials are far better suited for high voltage applications.

Capacitors can be manufactured to serve any purpose, from the smallest plastic capacitor in a calculator, to an ultra capacitor that can power a commuter bus. NASA uses glass capacitors to help power up the space shuttle's circuitry and help deploy space probes. Merely illustrating some of the different types of capacitors and how they are commonly used are the following.

Air dielectrics: Often used in radio tuning circuits;

Mylar dielectrics: Most commonly used for timer circuits like clocks, alarms and counters;

Glass dielectrics: Good for high voltage applications;

Ceramic dielectrics: Used for high frequency purposes like antennas, X-ray and MRI machines;

Similarities and Differences between the Two Power Supply Cache Formats

1. Once a capacitor becomes electrically charged via a circuit, the capacitor will have the same voltage as a cell battery of the same charge. For example, a charge of 1.5 volts on the capacitor is identical to a charge of 1.5 volts on the battery cell. The amount of electric charge can therefore be varied from the extremely small voltage to an enormously large voltage.

For a small sized capacitor, the voltage capacity is also small. Nevertheless, large capacitors are often made that hold quite a lot of electric charge; and capacitors as big as a soda can is able to hold enough electric charge to light a flashlight bulb for a minute or more.

A capacitor's storage potential, or capacitance, is measured in units called farads. A 1-farad capacitor can store one coulomb of charge at 1 volt. A coulomb is $6.25e^{18}$ ($6.25\times10^{18}$, or 6.25 billion billion) electrons. One amp represents a rate of electron flow of 1 coulomb of electrons per second, so a 1-farad capacitor can hold 1 amp-second of electrons at 1 volt.

A 1-farad capacitor would be considered to be very large indeed. In size, a 1-farad capacitor would likely be as big as a can of tuna or even the size of a 1-liter soda bottle, depending on the amount of voltage it can hold. For this reason, capacitors are typically measured in microfarads (millionths of a farad).

To gain some perspective on how big a 1-farad capacitor would be, consider the following:

A standard alkaline AA battery holds about 2.8 amp-hours.

That means that a standard alkaline M battery can produce 2.8 amps for an hour at 1.5 volts (about 4.2 watt-hours, on the basis that an AA battery can light a 4-watt bulb for a little more than an hour).

Assume that 1 volt is the charge (to make the example easier to understand). Therefore, to store the energy of one AA battery in a capacitor, you would need 3,600×2.8=10,080 farads to hold it (based on an amp-hour equaling 3,600 amp-seconds.

Consequently, if a capacitor must be at least the size of a tuna can to hold a farad, then a capacitor holding 10,080 farads is going far, far larger and take up enormously more space than a single AA battery cell! Thus, for these reasons, it is deemed impractical to use a capacitor circuit to store any significant amount of electric power, unless it is done at a high voltage.

2. Another major difference and meaningful distinction between a capacitor circuit format and a cell battery format as the power supply cache is that a capacitor can dump its entire electric charge in a fraction of a second, whereas a cell battery requires some minutes' time to discharge completely. This property can make a large, fully charged capacitor extremely dangerous; and many consumer electronics today have warnings against opening them because they contain large capacitors that potentially can kill with their electric charge if one accidentally causes their discharge.

3. Capacitors are conventionally used in several different ways within electronic circuits:

Capacitors are often used to store electric charge for high-speed use. The flash unit of a camera is operated by the quick discharge of power from a capacitor circuit. Large-sized lasers also use this capacitor circuits as well to get very bright, instantaneous flashes of light.

Capacitors can also eliminate ripples. As one common example, if a power line carrying DC (galvanic) voltage has ripples or spikes in it, joining a big capacitor to that power line can regulate and even-out the voltage by absorbing the peaks of current and adding current in the valleys.

A capacitor can block DC (galvanic) voltage. If a small capacitor is joined to a battery, then no current will flow between the poles of the battery after the capacitor becomes fully charged. However, any transmission of alternating current (AC) will flow through a capacitor unimpeded. This difference in effect occurs because the capacitor will repeatedly charge and discharge as the alternating current fluctuates, making it appear that the alternating current is flowing.

(4) Electrical Communication Means between the Functional Component and the Power Supply Cache.

In order that the reservoir of direct electric current stored within the power supply cache reach its intended destination, it is imperative that electrical communication means exist between them and electrically link the power supply cache to those functional components of the toy that actually drive and operate its activities—e.g., the electric motors for movement, or the electrically powered lamps, or the sound-emitting speakers. In this regard, any of the conventionally known and commercially sold formats for conveying direct electric energy from a discrete storage reservoir to an intended location, availability site, or energy-using entity residing in or upon the toy are deemed to be suitable and effective.

Accordingly, the electrical communications means can appear and often exist as: any wiring able to convey a galvanic voltage; microcircuits of varying size and complexity; a computer chip controlled circuitry; conductors and semi-conductors of electric current; and electrical connectors, voltage regulators, insulators, and grounds of any type or kind.

(5) Current Receptor Means for Receiving Direct Current from an Independent source On-Demand and Conveying Received Direct Current to the Power Supply Cache.

The current receptors are the tangible entities by which the toy construct will receive replenishment direct current from an independent outside source, and then convey the received direct current to the power supply cache for internal storage. As such, the current receptor means are a necessary and vital portion of the toy construct as a whole, for the reasons given below.

It must be remembered that, owing to the unique electric power requirements and structural relationships of the present invention, the following must be strictly observed.

(a) The replenishment electric current for the toy construct must be newly generated on each occasion at an outside, independent source;

(b) The replenishment electric current for the toy construct must be mechanically generated by electrical induction at the outside, independent source; and (c) The replenishment electric current mechanically generated by electrical induction at the outside, independent source must be transferred to the power supply cache of the toy construct for storage.

Accordingly, it is therefore necessary that the toy construct itself have identifiable means for receiving and conveying direct electric current transferred from the outside independent source of electric energy.

Tangible Formats

At a minimum, the current receptor means will appear as at least one and preferably two electrically conductive contacts or points which are sized, oriented, and aligned to be joined and lie in electrical flow communication with the independent source of electric energy. The contacts or points typically are made of a metal or metallic alloy; are demonstrably a con duct or or semi-conductor material; and will allow for physical contact and electrical flow of direct current on-demand.

In addition, it is also necessary that the current receptor means be able to convey the received direct current to the power supply cache for internal storage. For this purpose, any kind or type of wiring, circuitry, and/or micro-circuitry can be employed as needed or desired.

Location and Placement

The location and placement of the current receptor means on the toy construct is a matter of preferred design, engineering specification, and manufacturing facilities. The sole meaningful requirements for the current receptor means is that the location for juncture and electrical flow communication must be physically accessible in such a degree that at least a portion of the outside independent source of newly generated electric energy can be attached and detached at will for energy transfer purposes.

Accordingly, presuming for illustrative purposes that the current receptor means tangibly exist as an aligned pair of silver alloy bars with appropriate wiring & circuitry joined to the power supply cache of the toy, then several different site locations are possible.

A first possible choice is placing the aligned pair of silver alloy bars anywhere on the externally exposed surface of the fabricated toy body. For aesthetic reasons, such positioning is typically made at the least visible site on the toy's surface.

A second possible choice is placing the aligned pair of silver alloy bars along an obscured contour, deep curve, or valley forming a topological surface of the fabricated toy body.

A third possible choice is placement of the aligned pair of silver alloy bars in a prepared recess which extends inwardly from the external surface of the fabricated toy body. The recess has been carefully prepared in advance to conform to specific dimensions and to provide a limited three-dimensional space suitable for at will electrical connection to and disconnection from the outside independent source of newly generated electric energy.

B. The Discrete Supporting Assembly:

The supporting assembly of the invention will routinely offer several different enabling features and capabilities.

First and foremost, the supporting assembly is able to be repeatedly attached to and detached from the toy construct at will. Via this attribute, the supporting assembly is a completely independent article separate from the toy construct itself.

Second, the supporting assembly supplies the hand-operable means for mechanically generating direct current by electrical inductance. Consequently, this apparatus offers the ability to generate replenishing electric energy at will, and thereby provides the energy to recharge the power supply cache of the toy construct on-demand.

Third, the module shell of the supporting assembly can and typically does—but need not necessarily always—serve as a portable mounting platform for the toy construct—that is, part of the assembly provides a purposely dimensioned arranged fitting which can be physically attached to and subsequently detached from the fabricated body of the toy construct at will.

Fourth, the supporting assembly as a whole can often and typically does—but need not necessarily always—be employed as a launcher base, mooring dock, or site of departure for the toy construct—that is, the assembly maintains the toy in an appropriate position and orientation as the functional actions of the toy begin and the activity of the toy enters into a full-power operational status.

Figure 2:
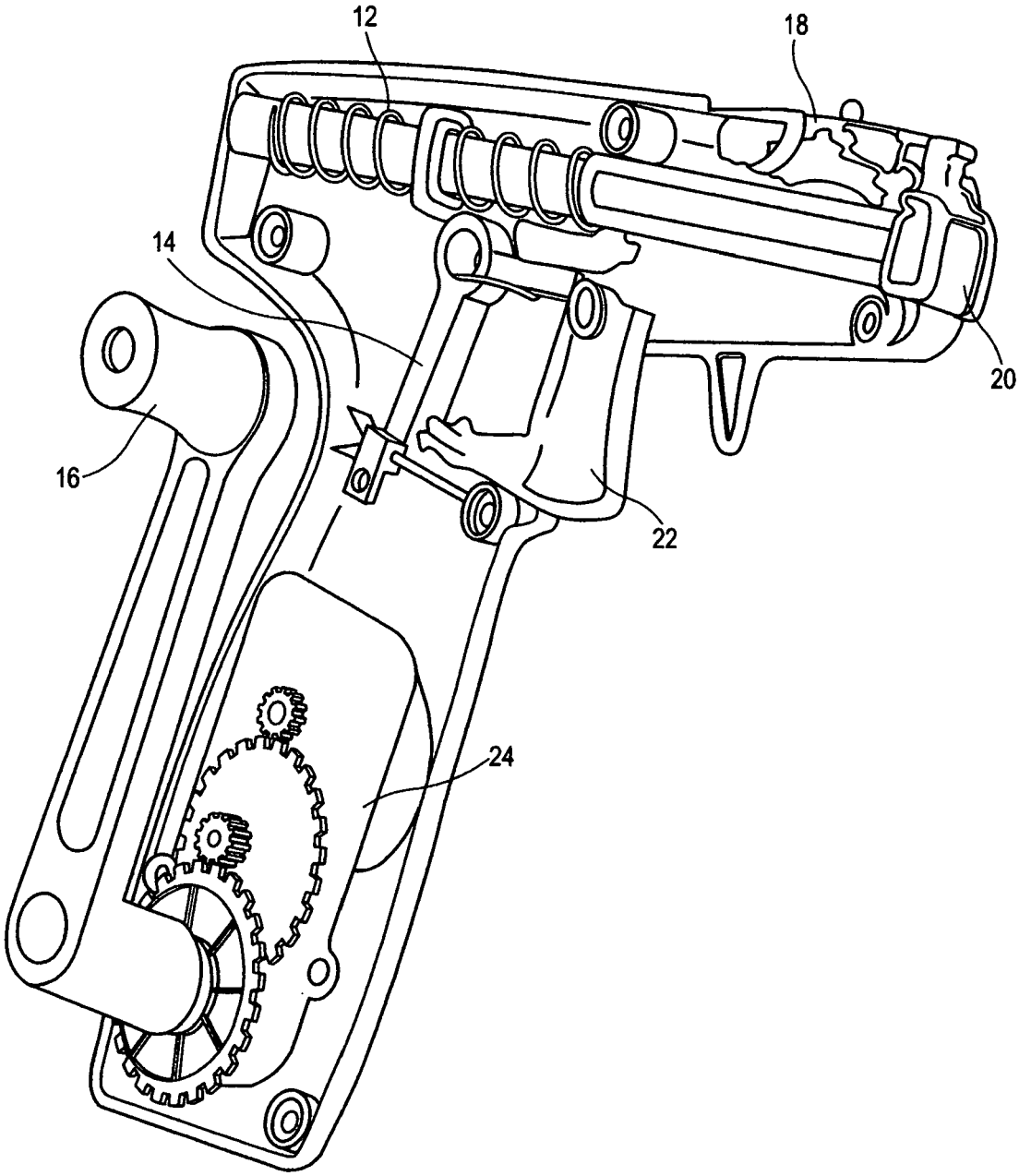
FIG. 2 illustrates a representative embodiment of the independent supporting assembly as a whole.

A typical embodiment representative and illustrative of the supporting assembly as a whole is shown by FIG. 2. As seen therein, the supporting assembly 10 is a discrete and independent entity able to be repeatedly attached to and detached from the toy construct (shown in FIG. 1). This particular supporting assembly comprises a pistol-shaped module shell 12 of preset dimensions which is adapted for at will electrical connection to and disconnection from the toy construct. As such, the modular shell 12 includes a hand-operable mechanical dynam 24 and a rotary crank 16 for generating electrical energy by mechanical induction on-demand, as well as a commutator structure (not shown)which lies in communication with the mechanical dynamo and is adapted for converting the inducted electrical energy into direct current; and provides electricity transfer contacts 18 in communication with the mechanical dynamo 24 for transferring any newly generated direct current to the toy construct on-demand.

The hand-holdable module shell 12 shown by FIG. 2 also includes an arranged fitting 20 which is suitable for at will attachment to and detachment from the toy construct. This arranged fitting 20 not only provides site placement for the electricity transfer contacts 18; but also offers a combined launch assist spring, a spring-powered launch assist rack, and release trigger mechanism 22 which aids in the at will detachment of and take-off for the toy construct.

Accordingly, as exemplified by FIG. 2, each embodiment of the discrete supporting assembly, the second essential part of the invention, will demonstrate and comprise the following singular structural features and capabilities:

(i) A module shell of preset dimensions and fixed overall shape adapted for at will electrical connection to and disconnected from the toy construct.

The module shell is a hollow casing or housing which has been manufactured to comply with prechosen engineering specifications and to present any an aesthetically acceptable external appearance or design. As a tangible entity, the module shell can comply with any desired set of dimensions; can conform to any intended configuration; and can occupy any specific spatial volume.

Moreover, the module shell may appear in any desired spatial form. Accordingly, it may be geometrical or non-geometrical; symmetrical or non-symmetrical; regular or irregular; continuous, or contiguous, or interrupted; fragmented or unitary; and present one topological surface or multiple topological surfaces.

The internal cavity space and volume of the hollow module shell may be expanded or diminished as necessary or desired in its engineering specifications so long as sufficient cavity volume exists by which to enclose and contain at least some of the other requisite components comprising the supporting assembly as a whole. Thus, it is intended and expected that the bulk of the dynamo mechanism, the entire commutator structure, and at least a part of the energy transfer means for the supporting assembly will be held and contained within the internal cavity space of the module shell.

In its preferred embodiments, the module shell will be a portable entity; and in the most preferred forms, it will be sufficiently small that it can be comfortably carried by a child less than ten years of age. Similarly, there are no limits or restrictions concerning either the weight or the mass of the module shell. Nevertheless, the better embodiments of the module shell will typically weight less than about 1 lb; will commonly range in overall size from about 3 inches to 3 feet; and will often have a girth of less than about 15 inches. Attention is again directed to the examples of FIGS. 1 and 2 respectively which individually show representative embodiments and illustrative examples of a hollow module shell.

In its most preferred formats, the module shell will include and provide an arranged fitting—i.e., a carefully prepared discrete external plane, platform, or projection which is integral with and forms an extended part of the module shell. The arranged fitting is fashioned to be dimensioned, oriented, contoured, and aligned for at will temporary juncture to and subsequent removal from the fabricated body of the toy construct; and will provide at least some of the wiring and circuitry for repeated electrical connection to and subsequent disconnection from the current receptor means of the toy construct on-demand.

The Composition of the Module Shell

The materials which can be used to make or to fashion the module shell encompass and include any resilient and malleable composition; and preferably is chosen from the chemically synthesized compositions created by man. The full range and diversity of suitable choices is only illustrated by: the known varieties of wood, wood-like, paper, and paper pulp products; the conventionally available metals, metal alloys, metallic mixtures, and composite metallic products; the commonly used kids of glasses, clays, porcelains, and ceramics; and any and all plastics in their various formulations and combinations including polyethylene, polypropylene, acrylics, and the like. In short, almost any substance known to man may be employed alone or in combination with other matter as the material from which to fabricate the module shell.

In addition, the module shell optionally may be augmented by any or all of the following: The exterior of the module shell can be colored, painted, or overlaid in any manner, style, or degree; or be sheathed, laminated, or covered by one or more layers of other matter; or have sculpted features, convoluted surfaces, or shaped contours; or show an appearance resembling commonly recognized objects, particular characters or personalities (fictional or real), or imaginary beings and things.

The fabrication of the module shell can be achieved in parts or as a whole; can be performed by any and all conventionally known modes of manufacture and assembly; and will often utilize several differently manufactured parts which are then joined together to yield the complete article. Thus, some of the more commonly used manufacturing techniques will include moldings, castings, extrusion processes, stamping, and sheet metal bending. Similarly, among the many different conventionally known bonding and attachment methods typically used to join individual parts together are glues, adhesives, and epoxies of individual and diverse formulation; snap fits and interference fits; sonic welding or soldering, thermal welding or soldering, radiation bonding, and metallic welding; and riveting, and the many different kinds of physical coupling such as nails, screws, and nuts & bolts.

(ii) A hand-operable mechanical dynamo able to generate electric energy by mechanical induction on-demand.

A dynamo, by definition, is a machine that converts inputted mechanical energy into outputted electrical energy. The dynamo commonly achieves this conversion thru the movement of a wire coil which travels back and forth within a magnetic field. The result of this mechanical action is the generation of a flowing stream of charged electrons in the form of an alternating electrical current. The term "dynamo" is properly employed to denote any kind or type of electromagnetic generator, but is more traditionally used to identify only those mechanisms which are direct current generators.

The mechanical structure of a typical dynamo uses rotating coils of wire moving thru magnetic fields to convert mechanical rotation into alternating electric current initially; and then, via a commutator acting in accordance with Faraday's law, into a pulsing direct electric current.

Figure 3:
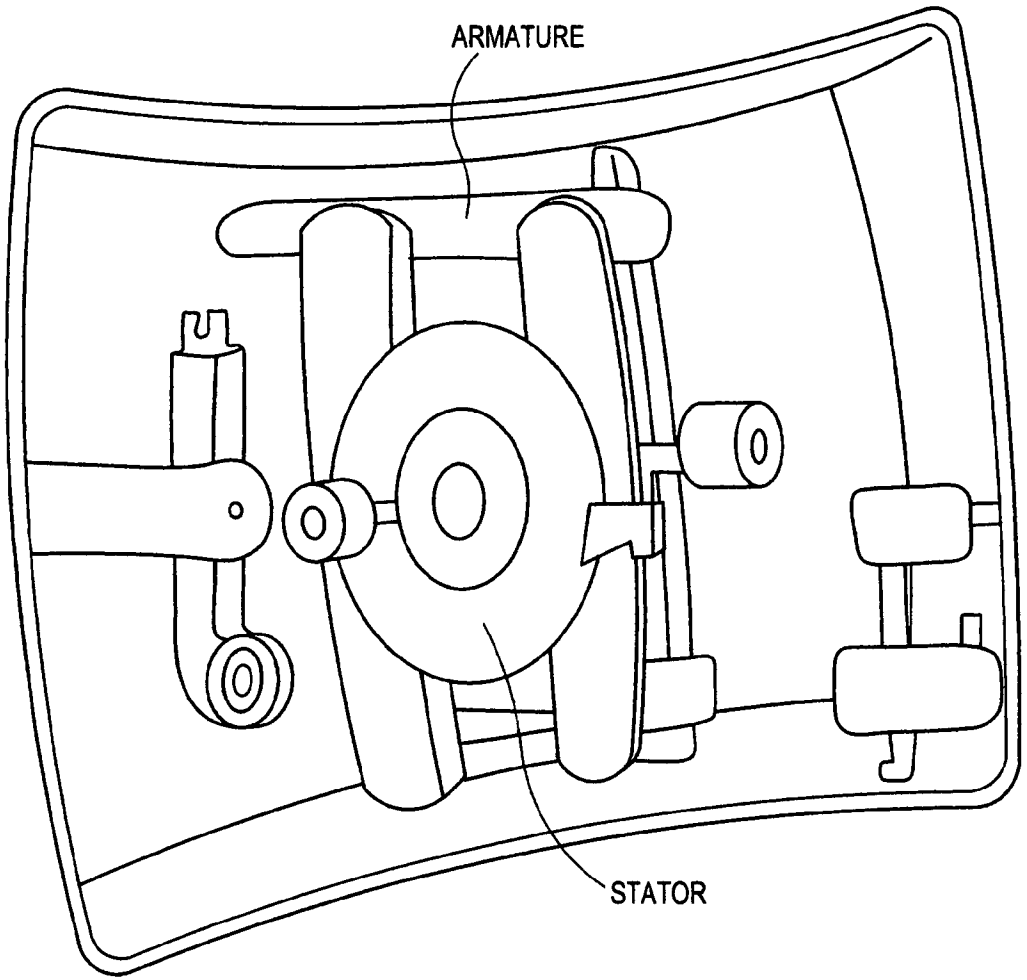
FIG. 3 illustrates a representative embodiment of the dynamo mechanism.

Accordingly, a dynamo mechanism suitable for use in the present invention typically comprises: a stationary structure, called the "stator", which provides a constant magnetic field; and a set of rotating windings, called the "armature", which turn within that constant magnetic field. A simple embodiment representing and illustrating the dynamo mechanism is shown by FIG. 3.

On small-sized dynamo mechanisms, the constant magnetic field may be provided by one or more permanent magnets; however, with larger-sized dynamo mechanisms, the constant magnetic field is often created by using one or more electromagnets, usually called "field coils". Nevertheless, every mechanical dynamo will comprise the two requisite structures, a stationary stator and a rotable armature of wire windings.

It will be recognized and appreciated also that the armature of the dynamo mechanism must be physically rotated around the stationary stator in order to generate electricity by inductance. Thus some manner of force must be applied upon the armature for it to turn within the constant magnetic field of the stator; and the larger the physical size and/or mass (or weight) of the armature of wire windings, the greater the quantity of force that must be exerted to cause meaningful rotation of the armature.

For these reasons, as dynamo structures were developed to generate ever-increasing amounts of electric current, many different kinds of non-human sources of power—such as animal driven gearing, gravity pull systems, water-wheels and other hydraulic systems, windsheets and windmills —were harnessed and employed to rotate the armature at relatively high speeds. Today, however, specially built high speed motors are most often used to power the modern dynamo mechanisms for the generation of high current electricity.

For purposes of the present invention, however, it is required that the mechanical dynamo be operated by human effort (i.e., powered by the human hand or foot) in every instance and embodiment. No other means of power or rotation other than human manual effort and force shall be used to operate the dynamo mechanism for the induction and production of electrical current on-demand; and no access to any other source of newly generated electrical current is either desired or needed by the present invention.

Principles of Electrical Induction

In 1824, Oersted discovered that current passing though a coil created a magnetic field capable of shifting a compass needle. Seven years later, Faraday and Henry discovered just the opposite. They noticed that a moving magnetic field would induce current in an electrical conductor. This process of generating electrical current in a conductor by placing the conductor in a changing magnetic field is called "electromagnetic induction" or simply "induction". It is called so because the electric current is said to be induced within the conductor by the surrounding magnetic field.

Faraday also noticed that the rate at which the magnetic field changed also had an effect on the amount of current or voltage that was induced. Faraday's Law for an uncoiled conductor states that the amount of induced voltage is proportional to the rate of change of flux lines cutting the conductor. Faraday's Law for a straight wire is shown below.

$$V_L = \frac{d\phi}{dt}$$

Where: VL=the induced voltage in volts; and dø/dt=the rate of change of magnetic flux in webers/second.

Induction is measured in unit of Henries (H) which reflects this dependence on the rate of change of the magnetic field. One Henry is the amount of inductance that is required to generate one volt of induced voltage when the current is changing at the rate of one ampere per second. Note that current is used in the definition rather than magnetic field. This is because current can be used to generate the magnetic field and is easier to measure and control than magnetic flux.

Short History of Electric Power Generation by Dynamos

In 1827, the Hungarian Anyos Jedik started experimenting with electromagnetic rotating devices, which he called "electromagnetic self-rotors". In the prototype of his single-pole electric starter (created between 1852 and 1854), both the stationary and the revolving parts of the device were electromagnetic. Jedlik formulated the concept of the dynamo at least six years before Siemens and Wheatstone did their pioneering work, but Jedlik did not patent it because (mistakenly) he thought he was not the first to realize this achievement. Structurally, the Jedlik dynamo used two electromagnets (instead of permanent magnets) which were positioned opposite to each other to induce the magnetic field around the rotor. Today, Jedlik's invention is recognized as being decades ahead of its time.

The first British direct current dynamo was invented by Michael Faraday in 1831. The earliest Faraday device utilized a copper disk that was rotated between the poles of a magnet. However, the single current path in Faraday's disk device was able to generate only a very low voltage.

Subsequently, Faraday (and other British innovators) found that higher, and more useful, voltages could be produced by winding multiple turns of wire into a coil. Then, as dynamos began to be used in British industry, it was found to be more economical to transport electricity at higher voltages. Since power is equal to the voltage times the current, the desired higher voltages required less current, and consequently allowed the use of narrower, less expensive conductors. Also, because wire windings can conveniently produce any voltage desired by changing the number of wire turns in a winding, such wire windings have therefore been used routinely in all later dynamo mechanisms.

The first dynamo based on Faraday's scientific principles was built in 1832 by Hippolyte Pixii, a French instrument maker. The Pixii apparatus used a permanent magnet which was rotated to spin by a crank. The spinning permanent magnet was positioned such that that its North and South magnetic poles passed by a piece of iron wrapped with wire. Pixii found that the spinning magnet produced a pulse of current in the wire each time a pole passed the coil. However, the North and South poles of the magnet induced currents in opposite directions, giving rise to an alternating electric current. Therefore, in order to convert the alternating current to direct current, Pixii invented a commutator—a split metal cylinder placed upon the shaft of the spinning magnet, with two springy metal contacts that pressed against it.

In addition, all of these early dynamo designs and devices suffered from a commonly shared problem: the electric current they produced appeared in the form of "spikes" of electric current followed by internals of no flow of electric current at all. Antonio Pacinotti, an Italian scientist, solved this problem around 1860 by replacing the spinning two-pole axial coil with a multi-pole toroidal one, which he created by wrapping an iron ring with a continuous winding, connected to the commutator at many equally spaced points around the ring; the commutator being divided into many segments. This meant that some part of the coil was continually passing by the magnets, smoothing out the current.

Zénobe Gramme utilized and applied the Pacinotti concept in 1871, when he designed the first commercial electric power plants (which operated in Paris during the 1870s). A major advantage of Gramme's approach and design was a better path for the magnetic flux—which was achieved by filling the space occupied by the magnetic field with heavy iron cores and minimizing the air gaps between the stationary and rotating parts. The Gramme dynamo was the first machine to generate commercial quantities of power for industry. Further improvements were made on the Gramme ring; but the basic concept of a spinning endless loop of wire remains at the heart of all modern dynamos today.

The first American dynamo mechanism was created by Charles Brush during the summer of 1876, and used the scientific principles of his European predecessors. Brush used a horse-drawn treadmill to turn the magnetic field coils and generate electricity. The Brush invention is described and manifested by U.S. Pat. No. 189,997 issued Apr. 24, 1877, entitled "Improvement In Magneto-Electric Machines".

The Subsequent Development of Electric Motors

While not originally designed for the purpose, it was incidentally discovered that a dynamo mechanism can act as an electric motor when supplied with direct current from a battery or another dynamo. This capability was first observed at an industrial exhibition in Vienna in 1873, where Zénobe Gramme noticed that the shaft of his dynamo mechanism (described above) began to spin when its terminals were accidentally connected to another dynamo producing electricity. Although this wasn't the first example of an electric motor, it was the first demonstration of a practical and useful design. It was later found that the same design features which make a dynamo efficient also will make an electric motor efficient. Thus the efficient Gramme designed mechanism, with its small magnetic air gaps and many coils of wire attached to a many-segmented commutator, became the design basis for the manufacture of all practical direct current motors.

Large dynamos producing direct electric current were problematic in situations where two or more dynamos are working together and one has an engine running at a lower power than the other. The dynamo with the stronger engine will tend to drive the weaker as if it were a motor, against the rotation of the weaker engine. Such reverse-driving would often feed back into the driving engine of a dynamo and cause a dangerous out of control reverse-spinning condition in the lower-power dynamo. To solve this problem, it was eventually determined that when several dynamos all feed the same power source all the dynamos must be locked into synchrony using a jackshaft interconnecting all engines and rotors to counter these imbalances.

Since that time, many industrial dynamos of varying construction have been developed and used for the large scale commercial generation of high current electric power. Among these are the innovations described by U.S. Pat. Nos. 3,374,376; 3,396,296; 3,535,572; and 4,074,159 respectively. The entirety of the written disclosure for each of these issued U.S. patents is expressly incorporated by reference herein.

In a similar manner, more complicated industrial machines able to act as both an electric generator and as an electric motor have become increasing prevalent. Merely exemplary of these latter developments are the inventions disclosed by U.S. Pat. Nos. 1,889,208; 1,893,629; 2,279,690; 4,019,103; and 4,237,395 respectively. The entirety of the written disclosure for each of these issued U.S. patents is also expressly incorporated by reference herein.

(iii) A commutator structure in communication with the mechanical dynamo and adapted for converting the generated electrical energy into direct current.

A commutator, by definition, is a set of contacts mounted on the shaft of a dynamo which reverses the connection of the windings to the external circuit when the potential reverses—such that, instead of alternating current, a pulsing direct current is produced. In short, if a hand operable dynamo mechanism is to produce a steady flow of direct electric current, a commutator structure must always be part of the overall assembly.

Figure 4:
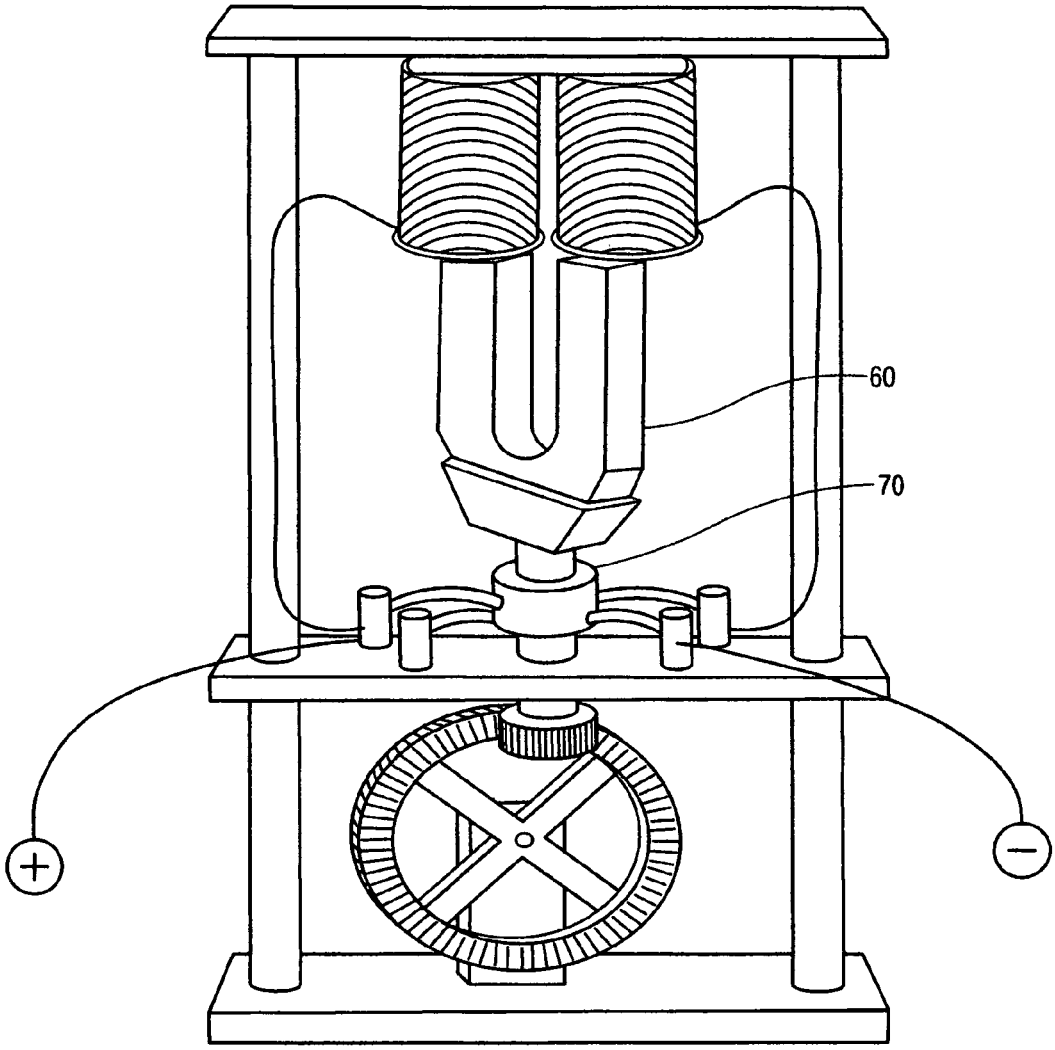
FIG. 4 illustrates a simple format of a dynamo in combination with a commutator structure.

To illustrate this mechanical capability, a very simple commutator structure is illustrated by FIG. 4. As seen therein, the rotating magnet 60 of the dynamo mechanism is physically and electrically linked to the commutator 70; and this linkage results in a reversal of the connection of the windings to the external circuit when the potential reverses and the production of direct current.

Terminology

After the discovery of the AC Generator and that alternating current can in fact be useful for something, the word dynamo became associated exclusively with the commutated DC electric generator; while an AC electrical generator using either slip rings or rotor magnets would become known as an "alternator". In comparison, note that an AC electric motor using either slip rings or rotor magnets was referred to as a "synchronous motor"; while a commutated DC electric motor could be called either a "generator" or an "electric motor", with the understanding that it could in principle operate as a generator.

The Problem Solved by the Commutator Structure

When a loop of wire rotates in a magnetic field, the potential induced in it reverses with each half turn, thereby generating an alternating current. However, in the early days of electric generation, alternating current as such had no known general use. The few uses for electricity at that time, such as electroplating, always used direct current; and direct current was then available only by using messy liquid batteries.

Clearly, dynamos were to serve as a complete replacement for electric batteries. Thus, the intentional inclusion of a commutator is a necessary and useful addition to the dynamo mechanism.

However, the early dynamo structures suffered from a secondary problem: the electric current they produced consisted of "spikes" of current, which were then followed by periods of no electric current at all. Antonio Pacinotti, an Italian scientist, solved this problem around 1860 by replacing the spinning two-pole axial coil with a multi-pole toroidal one. Pacinotti created his innovation by wrapping an iron ring with a continuous winding; and connected the continuously winded ring to the commutator at many equally spaced points around the ring, the commutator becoming divided into many segments. This addition meant that some part of the coil was continually passing by the stationary magnets, thereby smoothing out the induced current into a steady pulse-like flow.

Rotary Converter Developments

After dynamos were found to allow easy conversion back and forth between mechanical or electrical power, the new discovery was used to develop complex multi-field single-rotor devices with two or more commutators. Accordingly, these devices were known as a rotary converters; and such devices were usually not burdened by mechanical loads, but were merely spinning commutators on their own.

Rotary converters can directly convert any power source into any other as an internal part of the mechanism. This capability includes converting direct current (DC) into alternating current (AC); converting 25 cycle AC into 60 cycle AC; or conversion of many different output currents concurrently. Typically, the size and mass of these rotary converters was very large so that the rotor would act as a flywheel to help smooth out any sudden surges or dropouts.

The technology of rotary converters ruled until the development of vacuum tubes allowed for electronic oscillators. These electronic oscillators thus eliminated the need for physically spinning rotors and commutators within the dynamo mechanism.

Accordingly, in each and every embodiment of the supporting assembly in the present invention, the dynamo mechanism will include some recognized form of commutator structure.

(iv) Energy transfer means in communication with the mechanical dynamo and the commutator structure, and adapted for transferring direct current to the current receptor means of the toy construct on-demand.

The energy transfer means are the tangible entities by which the supporting assembly transports and delivers replenishment direct current to the current receptor means of the toy construct. As such, the energy transfer means are a necessary and vital portion of the supporting assembly as a whole, for the reasons given below.

It must be remembered that, owing to the unique electric power requirements and structural relationships of the present invention, the following must be strictly observed.

- The replenishment direct electric current intended to be transferred to the toy construct must be newly generated on each occasion by manually operating the mechanical dynamo and the commutator structure of the supporting assembly;
- The replenishment direct electric current intended to be transferred to the toy construct must be mechanically generated by electrical induction at the supporting assembly; and
- The replenishment direct electric current intended to be received by the toy construct must be transferred to the current receptor means of the toy construct from the supporting assembly.

For these reasons, it is therefore necessary that the supporting assembly have adequate means for becoming electrically connected to and disconnected from the toy construct at will, as well as for transferring newly generated direct electric current to the toy construct on-demand.

Tangible Formats

At one end, the energy transfer means will appear at least in part as one (and preferably two or more) electrically conductive coupling(s) or linker(s), which are sized, oriented, and aligned for electrical connection and disconnection at will with the current receptor means of the toy construct. The conductive coupling(s) or linker(s) are often comprised of a metal or metallic alloy; are formed using an electrical conductor or semi-conductor; and, after being joined in electrical flow communication to the current receptor means of the toy construct, will allow the transfer of direct current on-demand.

At the other end, the energy transfer means must also be in electrical flow communication with the mechanical dynamo and the commutator structure—i.e., the means for generating direct electric current by mechanical inductance. This portion of the energy transfer means will therefore often appear as a permanent electrical juncture and wire connection to the circuitry where the generated direct current flows as outputted energy.

Site Positioning

The placement of the energy transfer means on the supporting assembly construct is a matter of preferred design, engineering specification, and manufacturing facilities. The single requirement is that the transfer means be physically accessible in such a manner and degree that there is electrical flow communication with the corresponding current receptor means disposed upon the toy construct at will.

Accordingly, at least two different formats and site placements are available.

Figure 5:
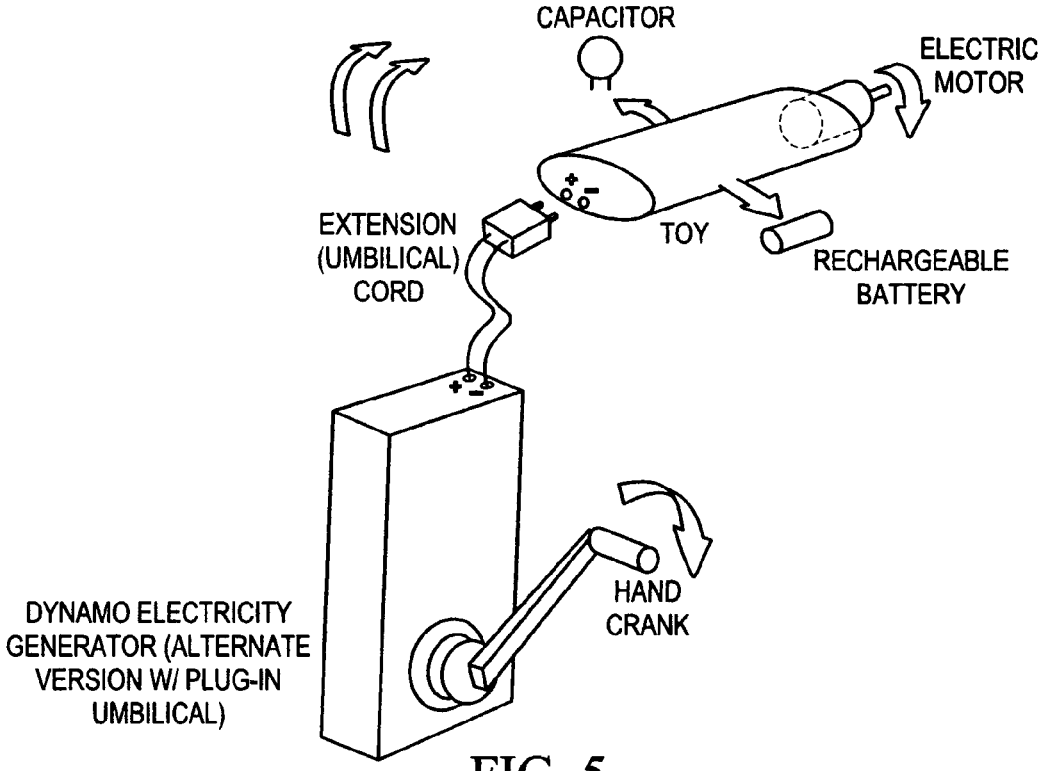
FIG. 5 illustrates the use of a plug-in electrical umbilical cord as the electricity transfer means of the supporting assembly for the transfer of replenishment electric current on-demand.

A first possible format is putting the electrically conductive coupling(s) at one end of an ordinary insulated wire (such as an extension cord wire) and attaching a conventional 2-prog plug to the other end. The format for the energy transfer means is thus portable and inexpensive; allows the prong end of the wire to be plugged into a common 2-hole receptacle which is joined to the power line carrying the generated direct electric current; and permits immediate and direct electrical connection and disconnection of the coupling (over the linear distance provided by the extension cord wire) to be joined to the current receptor means of the toy construct. This format and relationship is illustrated by FIG. 5.

Figure 6:
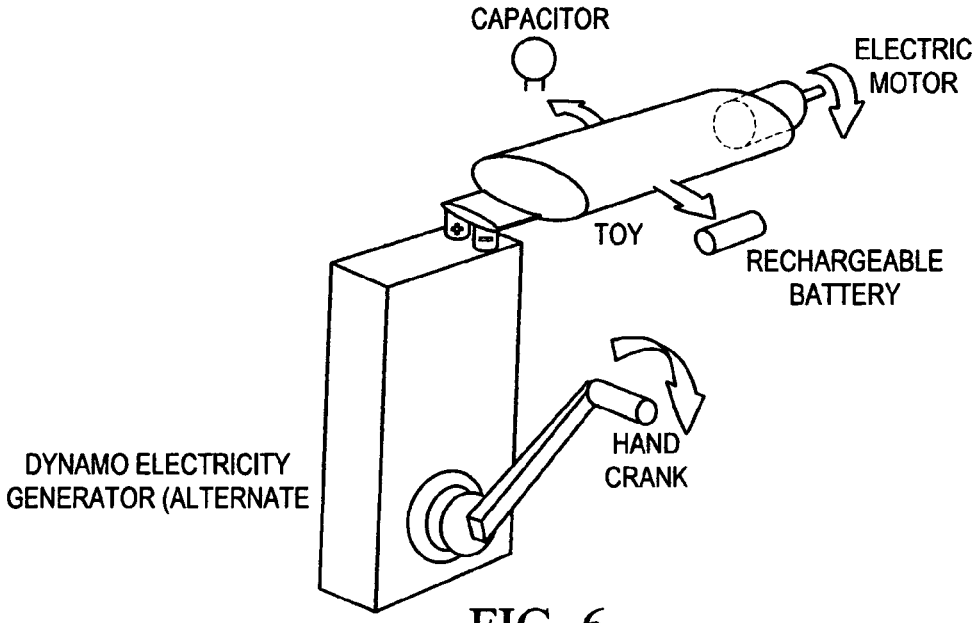
FIG. 6 illustrates the use of a positional support fitting on the body of the toy construct in combination with an arranged fitting present upon the supporting assembly for the transfer of replenishment electric current on-demand.

A second possible format is placing the electrically conductive coupling(s) on the arranged fitting of the module shell in the supporting assembly. In this instance, the electrically conductive coupling(s) is disposed upon a portion of the arranged fitting; and is coupling(s) is spatially oriented and aligned such that it is suitable for repeated electrical connection to and disconnection from the corresponding current receptor means disposed upon the toy construct at will. This format and relationship is illustrated by FIG. 6.

III. The Unique Differences And Unusual Distinctions Of The Subject Matter As A Whole Which Is The Present Invention Taken in its entirety, the present invention presents a broad range and variety of substantive differences which reveal the true merits of the present invention and meaningfully separate and distinguish the instant invention from predecessor toys. These major differences and marked distinctions include the following:

1. The present invention comprises two separate and discrete parts, an electrically powered toy construct and an independent supporting assembly capable of generating electrical energy at will.
2. The toy construct of the present invention will demonstrate at least one electrically powered functional activity, and can provide as many as three different kinds of electrically powered functional activities concurrently.
3. The toy construct of the present invention will operate individually and demonstrate its single functional activity (or multiple functional activities) independently from the supporting assembly.
4. The toy construct of the present invention can be physically attached to and detached from the supporting assembly at will.
5. The toy construct of the present invention can be electrically connected to and disconnected from the supporting assembly at will.
6. The primary functional activity able to be demonstrated by the toy construct of the present invention is motility.
7. The secondary functional activities able to be demonstrated by the toy construct of the present invention include light emission and/or sound emission.
8. The toy construct of the present invention provides a self-contained power supply cache of direct electric current—which repeatedly can receive and store electric energy in limited quantities; can be completely exhausted repeatedly; and then can be repeatedly replenished in full on-demand.
9. The power supply cache of the toy construct is the only immediately available reservoir of direct electric current to power and operate the functional activity component (s) in the toy construct of the present invention.
10. The supporting assembly of the present invention is the sole source of replenishment electrical energy for the toy construct and alone provides the tangible means for generating an electrical current at will.
11. The means for generating an electrical current contained within the supporting assembly of the present invention will include a hand operable mechanical dynamo and a commutator structure able to generate direct current by electrical inductance on-demand.
12. The direct electric current must be newly generated on each occasion via the hand operable mechanical dynamo and the commutator structure of the supporting assembly, before being transferred to the toy construct.
13. The direct electric current newly generated by the supporting assembly of the present invention can be transferred to the toy construct on-demand.

These substantive differences and distinctions clearly evidence and markedly demonstrate the unique attributes and unforeseen characteristics of the inventive subject matter as a whole. These singular features, structural qualities, and operational capabilities are not trivial, nor superficial, nor commonplace; neither are they matters of subjective choice, personal convenience, or aesthetic preference. To the contrary, these requisite structures and essential working relationships of the instant invention reveal an arrangement which is unique and is neither predictable nor foreseen by any person of ordinary skill who works today in the design and manufacture of electrically powered toys.

IV. An Exemplary Embodiment

Figure 7:
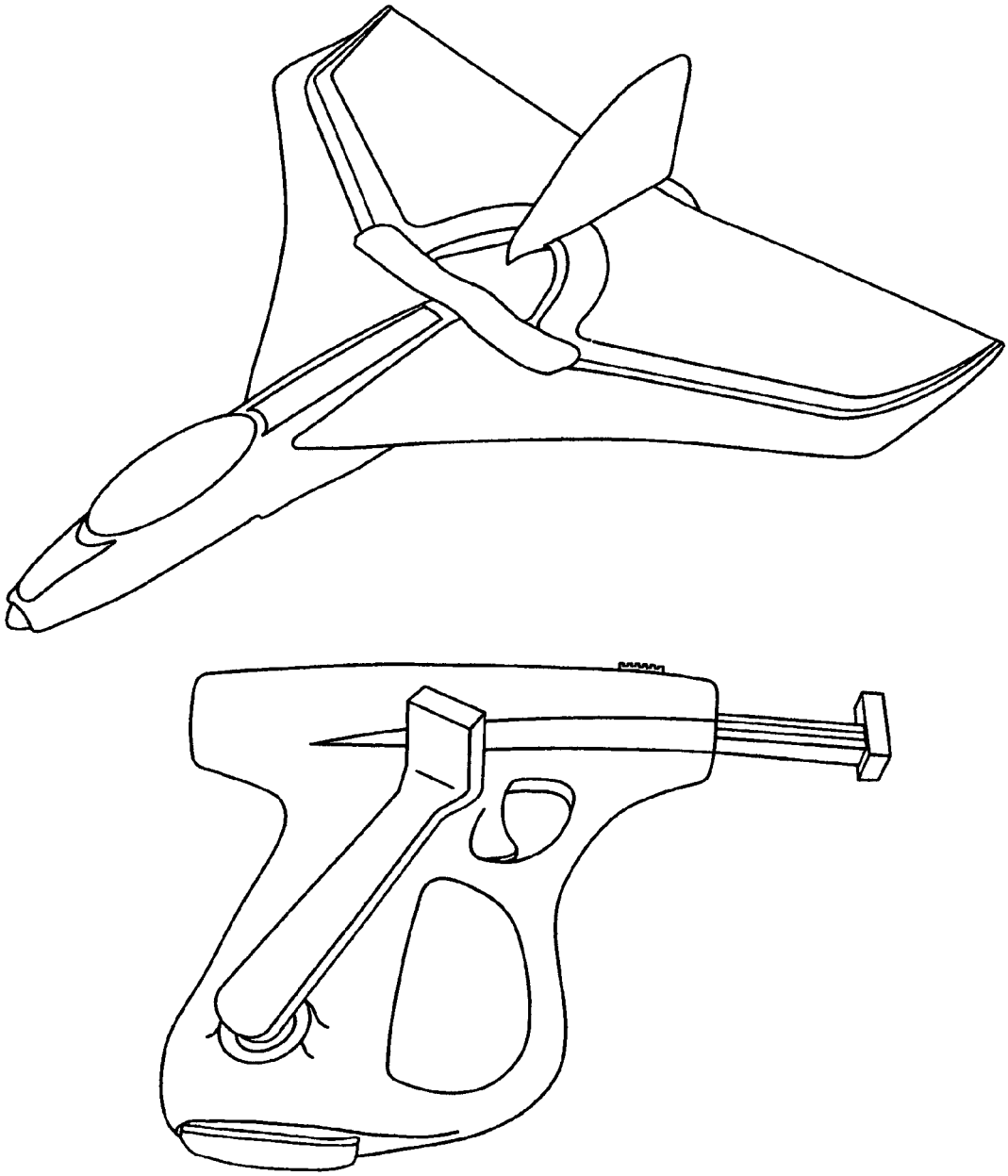
FIG. 7 illustrates another exemplary embodiment of the present invention comprising a model jet airplane as the toy construct and a launcher base as the independent supporting assembly.
Figure 8:
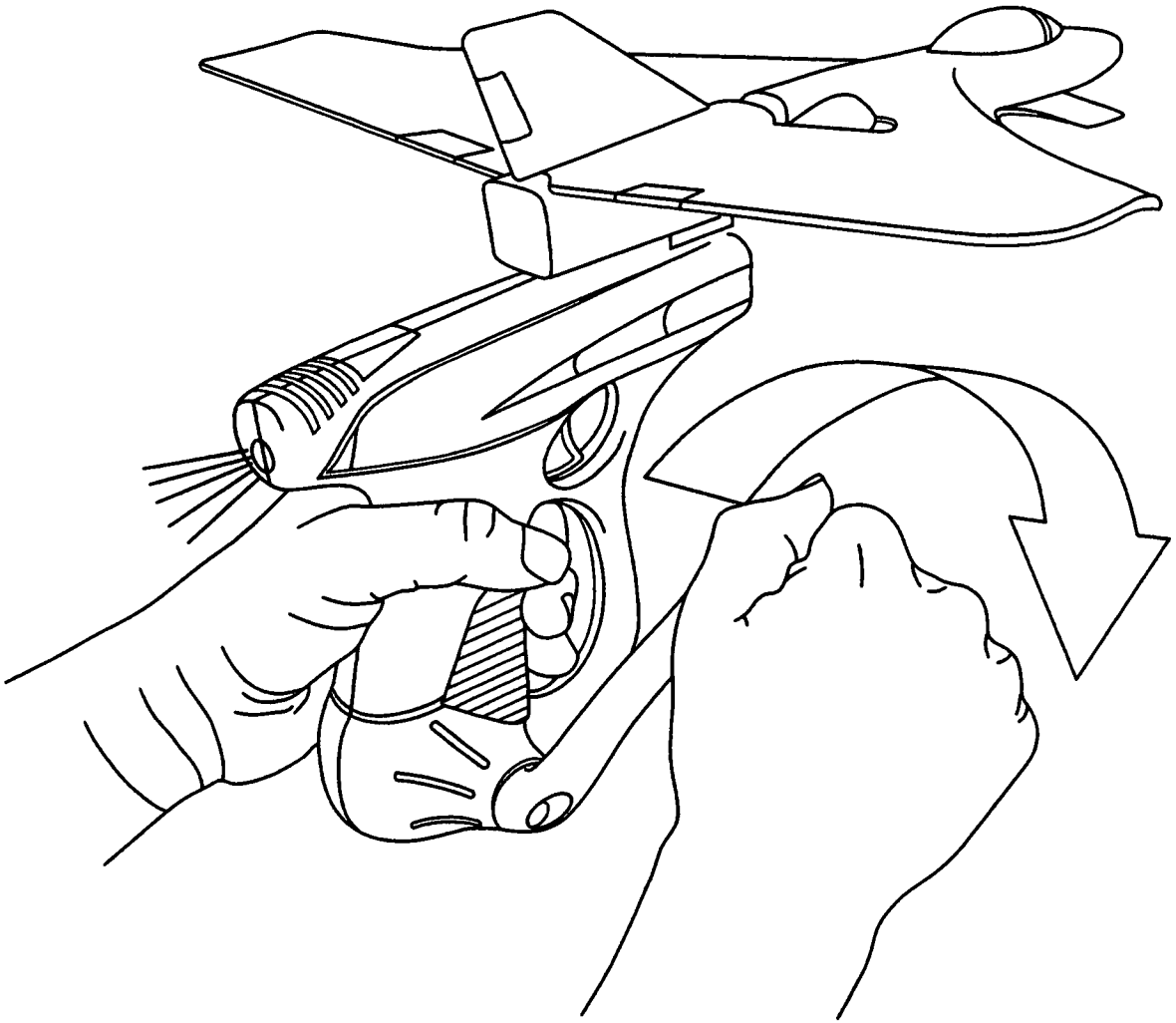
FIG. 8 illustrates how the transfer of replenishment electric current on-demand is made for the exemplary embodiment of FIG. 7.
Figure 9:
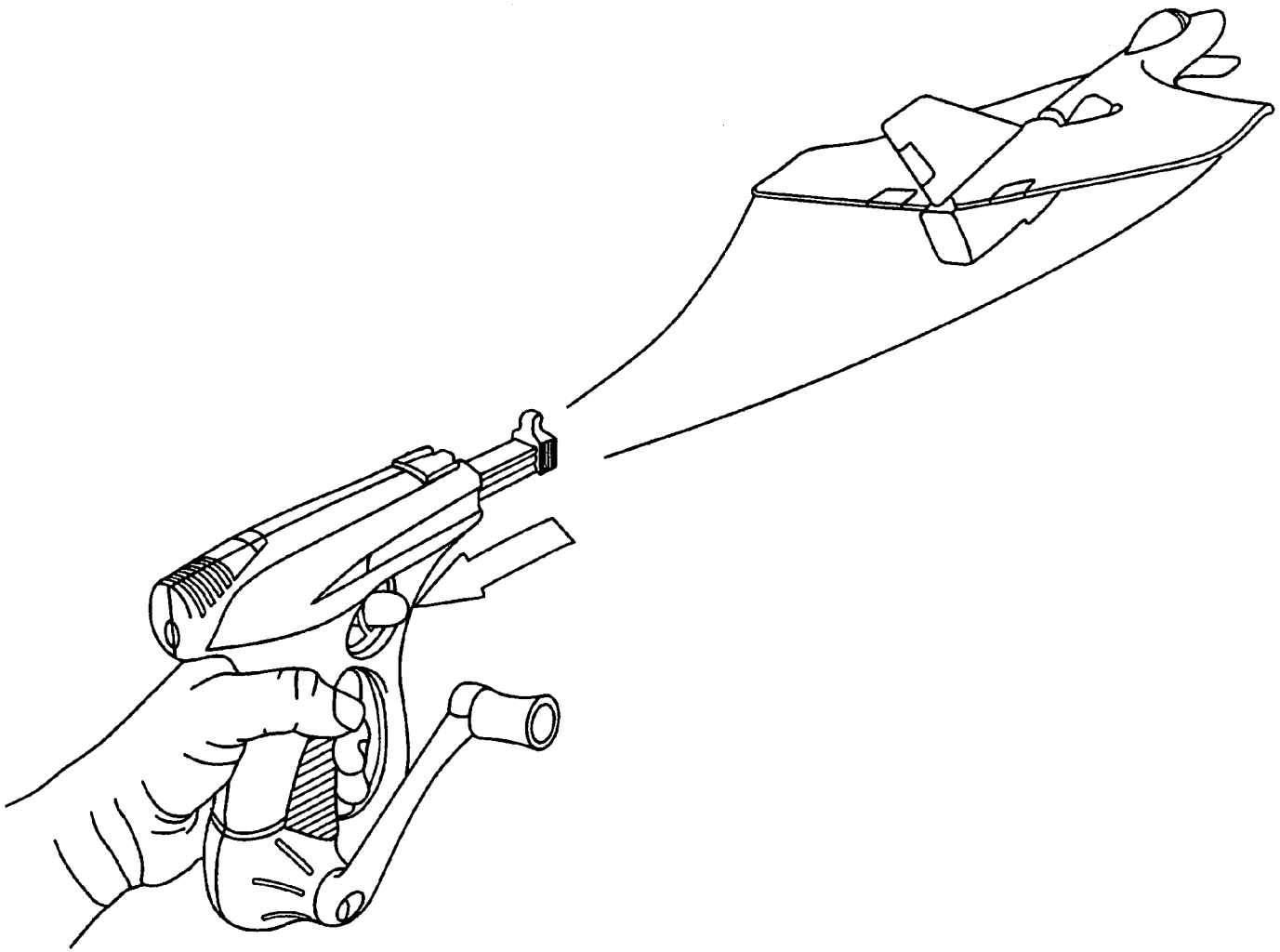
FIG. 9 illustrates how the replenished electric current in the model jet airplane is used to power the toy construct into actual flight.

A mechanically inducted, electrically powered toy exemplifying a preferred embodiment of the present invention is illustrated by FIGS. 7, 8 and 9 respectively. As seen therein, the complete motile toy comprises two essential parts: a toy construct which appears as a model jet plane; and a discrete supporting assembly which appears as the hand-held launcher unit.

The model jet airplane of FIG. 7, the toy construct proper in this exemplary embodiment, is an aeronautically sound structural aircraft. As shown, it will typically exist as a miniature version of one particular style or type of military airplane; and, if desired, can be patterned to be an engineering accurate reproduction of either a modern design or an older vintage format.

Also, note that the model jet plane of FIG. 7 is self contained: It has a fuselage and proper wings; and includes at least one electric motor which is powered by direct electric current to propel the model aircraft forward through the air. Thus, in this preferred embodiment, the motile component of the toy construct whose movement is powered by direct electric current is the electric motor having the ability to propel the model jet plane in a forward direction.

The launcher unit shown by FIG. 7—i.e., the independent supporting assembly of the invention—is a hand-held support device which provides three capabilities: First, a end portion of the launcher unit appears as an arranged fitting (see FIG. 8); and this end portion of the launcher has been sized, oriented and aligned such that it can be repeatedly temporarily attached to and subsequently detached from the model aircraft at will. In this manner, the end portion of the launcher unit will act as a hand-held base by which to physically support and retain the model jet plane in an upright position for an indefinite time period.

Second, when the launcher unit and the model jet plane are physically joined together, the launcher unit and the arranged end portion will also be in electrical flow communication with the electric current receptor means of the toy construct (see FIGS. 2 and 8); which, in turn, is then in flow communication and temporary juncture with the energy transfer means (i.e., the internal electric contacts and circuitry) then existing within the launcher unit itself (see FIGS. 2 and 8).

Third, the launcher unit incorporates and provides a hand-crankable (or otherwise manually-operated) dynamo mechanism and commutator structure —which in combination are mechanically able to generate direct electric current by electric inductance; and which, in turn, allows a child to hand operate and "power-up" (i.e., electrically charge) the toy on-demand; and thereby replenish at will the power supply cache of the model jet plane to its fullest extent with direct electric current.

Intended Manner Of Operation:

It is intended and expected that the child himself will place the model jet plane properly onto the arranged end portion of the launcher unit, such that the externally-sited current receptor means of the model plane is in direct electric juncture with the energy transfer means and the additional electric circuitry existing within the launcher. The child then grasps the handle of the dynamo/commutator mechanism and cyclically rotates the handle or "cranks" the unit for about thirty (30) seconds time or less. This procedure is illustrated by FIG. 8.

This hand-cranking action illustrated by FIG. 8 causes electrical inductance; and the rotating wire coils of the dynamo/commutator system mechanically generate electrical energy and a steady flow of direct current to the small power supply cache (typically a capacitor circuit) of the model aircraft, and electrically charges the power supply cache to its fullest extent.

It should be noted that an alternative method for mechanically operating the dynamo/commutator system would be to use a handle that the child can squeeze open and closed repeatedly. In this mode of operation, the hand squeezing effort is passed thru a gear train mechanism, which then causes the dynamo mechanism to rotate internally, sending a charge thru the inductance system. The flow of electric energy is then converted in direct current; and then is carried away and transferred to the power supply cache in the model jet plane.

Then, when a mild spring assist of the launch device is triggered by the child, the model jet plane starts its electric motor; and as full power is achieved by the electric motor, the toy airplane becomes physically ejected away from the hand-held launcher and begins its electrically powered flight. These events are illustrated by FIG. 9.

The model aircraft will continue to fly until the electrical power storage duration of the power supply cache (typically a capacitor circuit) has been reached and the previously-stored electrical charge is depleted. Then, when the electric motor is no longer supplied with electrical energy by its internal power supply cache, the model aircraft will slowly glide back down to earth, and be ready for another replenishment charge of direct current from the launcher device and renewed flight. All the necessary electrical energy to power the electric motor of the model jet plane for flight is generated anew by electrical inductance and is transferred in full by the child—via mechanically cranking the dynamo/commutator mechanism and system of the launcher device on each use occasion, thereby building up a replenished electrical charge on each occasion within the model aircraft's on-board power supply cache.

The present invention is not to be limited in scope nor restricted in form, except by the claims appended hereto.

What I claim is:

1. A functional toy comprising:

An electrically powered toy construct able to demonstrate a discernible functional activity, said toy construct being comprised of (a) a fabricated body of predetermined dimensions and prechosen spatial configuration, (b) at least one functional component in said fabricated body whose activity is powered by direct current, (c) a power supply cache of direct current which can repeatedly receive and store direct current, be exhausted, and then be replenished with direct current on-demand, (d) electrical communication means between said functional component and said power supply cache, and (e) current receptor means for receiving direct current from an independent source on-demand and conveying received direct current to said power supply cache; and an independent supporting assembly able to be repeatedly attached to and detached from said toy construct, said supporting assembly being comprised of (i) a module shell of preset dimensions and fixed overall shape adapted for at will electrical connection to and disconnection from said toy construct, (ii) a hand-operable mechanical dynamo able to generate electrical energy by mechanical induction on-demand, (iii) a commutator structure in communication with said mechanical dynamo and adapted for converting said generated electrical energy into direct current, and (iv) electricity transfer means in communication with said mechanical dynamo and said commutator structure, and adapted for transferring direct current to said current receptor means of said toy construct on-demand.

2. The functional toy of claim 1 wherein said discernible functional activity of said toy construct is at least one selected from the group consisting of motility, light emission, and sound emission.

3. The mechanically inducted, electrically powered functional toy of claim 1 wherein said power supply cache of said toy construct appears as one form selected from the group consisting of a rechargeable capacitor circuit and a rechargeable energy cell unit.

4. The functional toy of claim 1 wherein said toy construct is a hand-held size.

5. The functional toy of claim 1 wherein said supporting assembly is a hand-held size.

6. A motile toy comprising:

an electrically powered toy construct able to provide a discernible manner of motion as a functional activity, said toy construct being comprised of (a) a fabricated body of predetermined dimensions and prechosen spatial configuration, (b) at least one motile component in said fabricated body whose movement action is powered by direct current, (c) a power supply cache of direct current which can repeatedly receive and store direct current, be repeatedly exhausted, and then be repeatedly replenished with direct current on-demand, (d) electrical communication means between said motile component and said power supply cache, and (e) current receptor means for receiving direct current from an independent source and conveying received direct current to said power supply cache; and an independent supporting assembly able to be repeatedly attached to and detached from said toy construct, said supporting assembly being comprised of (i) a module shell of preset dimensions and fixed overall shape adapted for at will electrical connection to and disconnection from said toy construct, (ii) a hand-operable mechanical dynamo able to generate electrical energy by mechanical induction on-demand, (iii) a commutator structure in communication with said mechanical dynamo and adapted for converting said generated electrical energy into direct current, and (iv) electricity transfer means in communication with said mechanical dynamo and said commutator structure, and adapted for transferring replenishment direct current to said current receptor means of said toy construct on-demand.

7. A motile toy comprising:

an integrated electrically powered toy construct able to provide a discernible manner of motion as a functional activity, said toy construct being comprised of (a) a fabricated body of predetermined dimensions and prechosen spatial configuration which includes a positional support fitting suitable for at will attachment to and detachment from an independent supporting assembly, (b) at least one motile component in said fabricated body whose movement action is powered by direct current, (c) an internal power supply cache of direct current which can repeatedly receive and store direct current, be repeatedly exhausted, and then be repeatedly replenished with direct current on-demand, (d) integrated electrical communication means between said motile component and said internal power supply cache, and e) current receptor means for receiving direct current from an independent source on-demand and conveying received direct current as a replenishment to said internal power supply cache; and an independent supporting assembly able to be repeatedly attached to and detached from said toy construct , said supporting assembly being comprised of (i) a hand-holdable module shell of preset dimensions and fixed overall shape which includes an arranged fitting for at will attachment to and detachment from said positional support fitting of said toy construct, and is adapted for at will electrical connection to and disconnection from said toy construct, (ii) a hand-operable mechanical dynamo which is at least partially contained within said module shell and is able to generate energy by mechanical induction on-demand, (iii) a commutator structure in communication with said mechanical dynamo and adapted for converting said generated electrical energy into direct current, and (iv) electricity transfer means in communication with said mechanical dynamo and said commutator structure, and adapted for transferring said direct current to said current receptor means of said toy construct on-demand.

8. The motile toy of claim 6 or 7 wherein said motile component of said toy construct is capable of multiple movement actions.

9. The motile toy of claim 6 or 7 wherein said power supply cache of said toy construct exists in a form selected from the group consisting of a rechargeable capacitor circuit and a rechargeable battery cell.

10. The motile toy of claim 6 or 7 wherein said fabricated body of said toy construct appears as a miniature model of a conventionally known machine.

* * * * *